US009630241B2

(12) United States Patent
Bovens

(10) Patent No.: US 9,630,241 B2
(45) Date of Patent: Apr. 25, 2017

(54) DEVICE AND METHOD FOR HARDENING FOUNDRY CORES

(71) Applicant: Lüber Gmbh, Bazenheid (CH)

(72) Inventor: Wilhelm Bovens, Bazenheid (CH)

(73) Assignee: Lüber GmbH, Bazenheid (CH)

( * ) Notice: Subject to any disclaimer, the term of this patent is extended or adjusted under 35 U.S.C. 154(b) by 85 days.

(21) Appl. No.: 14/428,537

(22) PCT Filed: Aug. 7, 2014

(86) PCT No.: PCT/EP2014/066972

§ 371 (c)(1),
(2) Date: Mar. 16, 2015

(87) PCT Pub. No.: WO2015/036184

PCT Pub. Date: Mar. 19, 2015

(65) Prior Publication Data

US 2016/0008873 A1 Jan. 14, 2016

(30) Foreign Application Priority Data

Sep. 11, 2013 (EP) ..... 13183850

(51) Int. Cl.
*B22C 9/10* (2006.01)
*B22C 9/12* (2006.01)
*B22C 19/00* (2006.01)

(52) U.S. Cl.
CPC ..... *B22C 9/123* (2013.01); *B22C 9/10* (2013.01); *B22C 19/00* (2013.01)

(58) Field of Classification Search
CPC .. B22C 9/10; B22C 9/12; B22C 9/123; B22C 19/00

(Continued)

(56) References Cited

U.S. PATENT DOCUMENTS 4,112,515 A * 9/1978 Sandow ..... B22C 9/123 137/101.19
4,359,082 A * 11/1982 Michel ..... B22C 9/123 164/16

(Continued)

FOREIGN PATENT DOCUMENTS

EP 1375031 B1 6/2006

OTHER PUBLICATIONS

International Search Report for PCT/EP2014/066972 dated Sep. 15, 2014.

*Primary Examiner* — Kevin P Kerns
(74) *Attorney, Agent, or Firm* — Dennemeyer & Associates, LLC

(57) ABSTRACT

A device for hardening foundry cores of a sand-containing molding material, wherein the core, for its hardening, is subjected in a core molding tool to a catalyst vapor/carrier gas mixture and subsequently to a pressurized air stream is provided. Each of the vapor/carrier gas and air stream are at a predetermined pressure and a predetermined temperature, wherein a heating and mixing stage, is connected to a container containing an organic catalyst in liquid form and to a pressurized air source. The liquid organic catalyst and the pressurized air are heated together in the heating and mixing stage. The device has a separate flushing line, wherein a first cutoff valve is arranged in the line to the heating and mixing stage, which is closed at the beginning of the flushing, and a second cutoff valve is arranged in the flushing line, which is open at the beginning of the flushing.

8 Claims, 1 Drawing Sheet

(58) Field of Classification Search
USPC ..... 164/16, 159
See application file for complete search history.

(56) References Cited

U.S. PATENT DOCUMENTS

| | | | | |
|---|---|---|---|---|
| 4,362,204 | A | 12/1982 | Moore et al. | |
| 5,971,056 | A * | 10/1999 | Bovens | B22C 9/123 164/16 |
| 6,505,671 | B1 * | 1/2003 | McKibben et al. | B22C 9/123 106/38.2 |
| 7,036,552 | B2 * | 5/2006 | Bovens | B22C 9/123 164/16 |

* cited by examiner

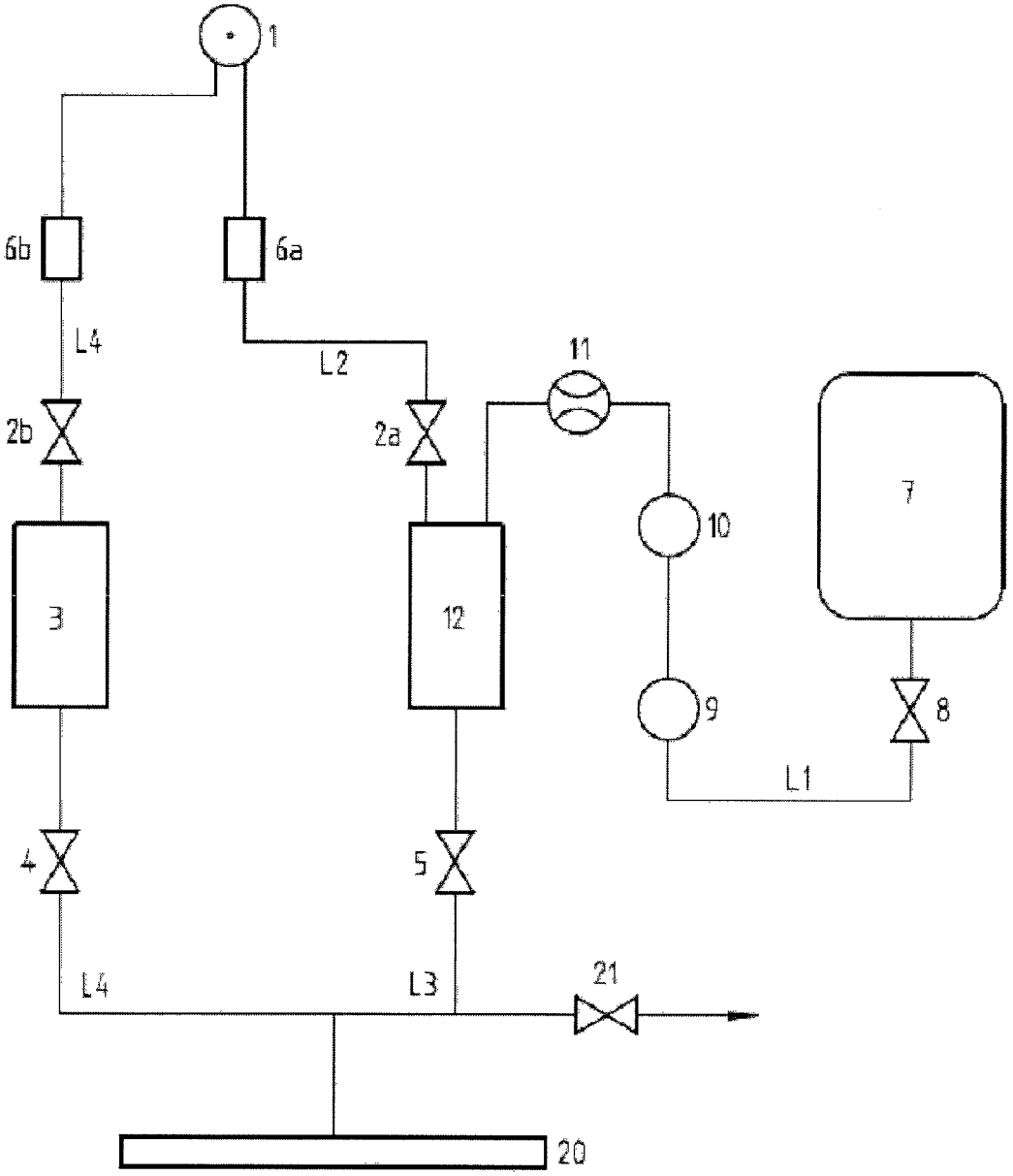
1
6b
6a
L4
L2
11
2b
2a
7
10
3
12
9
8
L1
4
5
L4
L3
21
20

DEVICE AND METHOD FOR HARDENING FOUNDRY CORES

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF A PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

The present invention relates to a device and to a method for hardening foundry cores of sand-containing molding materials, wherein the core, for its hardening, is subjected in a core molding tool to a catalyst vapor/carrier gas mixture by means of a gassing plate which can be coupled to the core molding tool in a gas-tight manner and subsequently to a pressurized air stream, each at a predetermined pressure and predetermined temperature.

(1) Field of the Invention

Such cold hardening methods and devices are known, for example, the so-called cold box method, in which two components of a synthetic resin system are added to the core sand, which then harden along with the sand as soon as an organic catalyst, such as an amine, for example, an alkylamine or a methyl formate, is added as catalyst.

Here, one of the components could be, for example, a polyester resin, a polyether resin or any synthetic resin having a fluid consistency with reactive hydroxyl groups; the second component in any case is an organic isocyanate. The two components are thoroughly mixed with the mold sand and then formed. In order to then catalyze the reaction and to design the handling and the use of particularly the amines reliably, various efforts have been undertaken to date.

(2) Description of Related Art Including Information Disclosed Under 37 CFR 1.97 and 1.98

However, the known methods and devices have a disadvantage in common in that the hardening process is very time consuming. For example, the forming of the core-sand mixture in the molding tool on a core shooting machine often takes only fractions of a second, whereas the subsequent gassing for hardening the core has to take place over several seconds, which naturally makes the gassing an enormous cost factor.

In order to reduce the gassing time or the hardening time, the proportion of the amines as a rule has been dosed in excess, with the risk that a renewed dissolution of the binder could occur, lowering the potential final strength of the core to approximately 80 to 85%.

In an additional method or device (EP 0229959 of the same applicant), dosing pumps are inserted between the catalyst source and the mixing site of the carrier gas and the catalyst, in order to be able to better dose the catalyst; however, this too can only lead to an unsatisfactory result, since the pressure conditions in the catalyst feed in each dosing process at first are completely without effect.

In addition, it has been proposed (CH Patent 603276 of the same applicant) to temporarily store both the catalyst vapor/carrier gas mixture and also the pressurized air each in a dosing container and then to perform the shooting successively in bursts from this dosing container into the core, wherein the pressurized air is stored with a greater volume and heated to a higher temperature than the catalyst vapor/carrier gas mixture.

However, the technical effort is enormous for these measures, and installations of this type allow few variables.

Furthermore, EP 0881 014 of the same applicant describes a method and a device of the above-mentioned type, in which the valve means comprise a multipath valve in the feed line of the storage tank, which can be rerouted temporarily to a return line to the storage tank for the pressure equalization in the feed system.

These measures make it possible to keep the pressure conditions in the catalyst feed constant in each dosing process, after a pressure equalization is carried out in each case beforehand.

Furthermore, EP 1 375 031 B1 of the same applicant describes a method and a device of the above-mentioned type, in which preheated pressurized air is fed through a switching valve to a heating and mixing stage and to a reheater through a line for further heating for the flushing. The advantage of this device or of this method is that the pressurized air for a gassing, with increasing heating of the catalyst vapor/carrier gas mixture, can be heated variably, in order to achieve a so-called contour hardening. One disadvantage of this device is that a precise monitoring of the temperature is required in order to ensure the safety of the installation.

Thus, the problem of the present invention is to provide a method for hardening foundry cores of sand-containing molding materials, and to provide a corresponding device by means of which, at constant speed or cycle time, a strong reduction of the emission at the work site is ensured by reduced catalyst consumption. Furthermore, as a result, the disposal costs and the cleaning effort for the device should be reduced and thus considerably lower environmental pollution should be achieved. In addition, the installation should be cost effective.

BRIEF SUMMARY OF THE INVENTION

The invention relates to a device for hardening foundry cores of a sand-containing molding material, wherein the device is adapted in order to subject the core, for its hardening, in a core-molding tool, to a catalyst vapor/carrier gas mixture and subsequently to a pressurized air stream, each at a predetermined pressure and predetermined temperature.

According to the invention, the device is characterized in that the device has no preheater that heats the pressurized air before it is fed to the heating and mixing stage or the heat source, so that the organic catalyst and the pressurized air are heated together in the heating and mixing stage, and in that a first cutoff valve is arranged in the second line which connects the pressurized air source to the heating and mixing stage, said first valve being closed at the beginning of the flushing, and in that a second cutoff valve is arranged in the fourth line which connects the pressurized air source via the heat source to the gassing plate, said second valve being open at the beginning of the flushing.

In an advantageous embodiment, the device has two gas sources, of which the first is connected to the heating and mixing stage and the second is connected to the heat source. Furthermore, it is advantageous to connect a temperature control to the heat source. Furthermore, it is advantageous if, before feeding the catalyst in liquid form to the heating and mixing stage, the flow of the liquid catalyst container or of the storage tank can be rerouted temporarily with a flow meter through a switching valve to a return line to the storage tank, for the pressure equalization in the feed system.

Furthermore, the present invention relates to a method for hardening foundry cores, which is characterized according to the invention in that the pressurized air, which is passed through the heating and mixing stage in order to achieve a time-controlled gassing, is heated only in the heating and mixing stage, together with the organic catalyst, and the pressurized air used for the time-controlled flushing is conducted and heated in a separate line by means of a heat source.

A preferred embodiment of the method according to the invention consists in that, before feeding the catalyst in liquid form into the heating and mixing stage, a pressure equalization is performed in the feed. Furthermore, it is advantageous if the catalyst vapor/carrier gas mixture is accompanied by heat on its way to the core molding tool.

BRIEF DESCRIPTION OF THE SEVERAL VIEWS OF THE DRAWING(S)

Below, the invention is explained in further detail in reference to the appended drawing which merely represents an embodiment example.

FIG. 1 shows: a diagrammatic representation of a device according to the invention for hardening foundry cores.

DETAILED DESCRIPTION OF THE INVENTION

In reference to FIG. 1, a device for hardening foundry cores of a sand-containing molding material is represented and described, which can be connected to a core molding tool, not shown in further detail, of a core shooting machine, not shown in further detail. The device first comprises a gassing plate or hood 20, which can be coupled in a gas-tight manner to the core molding tool, with an upstream heating and mixing stage 12 for converting the liquid organic catalyst, which is preferably an amine, to its gaseous state, and for generating a catalyst vapor/carrier gas mixture used for gassing of the core, as will also be explained in further detail below.

According to the invention, for a time-controlled gassing, the organic catalyst in liquid form runs from a storage tank or a liquid catalyst container 7 dosed by means of dosing means such as, for example, dosing valves 8 and 11, a dosing unit 9, a flowmeter 10 or the like, through a line L1 to the heating and mixing stage 12, where it is converted to its gaseous state. The heating and mixing stage 12 is additionally in fluidic connection with a pressurized air source 1 by a separate line L2, which can be closed with a cutoff valve 2*a*, and a proportional or a 2-stage pressure regulator 6*a*, in order to pass the pressurized air fed from the pressurized air source 1 via the cutoff valve 2*a*, for the time-controlled gassing, within a predetermined time period, through the heating and mixing stage 12 charged with the catalyst gas, wherein the pressurized air fed and the catalyst gas are heated together in the heating and mixing stage 12, resulting in a catalyst vapor/carrier gas mixture.

Furthermore, the heating and mixing stage 12 is connected by a line L3, which can be closed by a valve 5 and is preferably heatable, to the core molding tool or the gassing plate 20, in order to pass the catalyst vapor/carrier gas mixture through the sand-containing molding material in the core molding tool.

Furthermore, for a time-controlled flushing with the pressurized air, the pressurized air source 1 is in fluidic connection, via a separate line L4 which can be closed by a cutoff valve 2*b*, and optionally via a proportional or a 2-stage pressure regulator 6*b* and a heat source 3, as well as via a cutoff valve 4, with the core molding tool or the gassing plate 20.

Not shown in the FIGURE is that, before the feeding of the catalyst in liquid form into the heating and mixing stage 12, the feed of the liquid catalyst container 7 can be temporarily rerouted through a switching valve to a return line to the storage tank 7 for the pressure equalization in the feed system.

Furthermore, the gassing plate 20 is provided with a ventilation valve 21.

For example, a temperature control can be connected to the heat source 3 for a regulated heating of the pressurized air. Similarly, a temperature control can also be connected to the heating and mixing stage 12. In accordance with current technology, the switching means, the valves, the dosing means and the controls can be controlled by program using a control circuit that is not shown.

Thus, for the gassing process, it is now possible to feed the organic catalyst in liquid form dosed together with the pressurized air from a pressurized air source through respective separate lines to a heating and mixing stage, and to heat it there together with the pressurized air to a temperature which is sufficient for gassing the catalyst, so that the result is a catalyst vapor/carrier gas mixture, which is passed through the sand-containing molding material in the core molding tool through an additional line. During this gassing process, the cutoff valve of the line which feeds the pressurized air via the heat source to the gassing plate is closed, and the cutoff valve which feeds the pressurized air to the heating and mixing stage is open. For example, the required temperature of the amine as catalyst for gassing is between 80° C. and 110° C., wherein this depends on the type of the amine. Thus, it should be understood that the heating in the heating and mixing stage occurs in accordance with the gassing temperature of the catalyst used.

Furthermore, the pressurized air required for the flushing process, i.e., for a time-controlled flushing, can be passed within a predetermined time period through the gassed sand-containing molding material in the core molding tool, after it has been fed through a separate line to a heat source and heated there to a temperature that is higher than the temperature required for the gassing of the catalyst. The temperature for flushing is preferably between 150° C. and 180° C., more preferably 170° C. During this flushing process, the cutoff valve of the (fourth) line which feeds the pressurized air via the heat source to the gassing plate is open, and the cutoff valve which conducts the pressurized air through the second line to the heating and mixing stage is closed.

As gas source, a single gas source 1 can be used. In this case, both the second line L2 and also the fourth line L4 are connected to the gas source used as pressurized air source. However, it is also possible to use two separate pressurized air sources 1 (not shown in the drawing). In this case, the fourth line L4 is connected to the first pressurized air source for the flushing, and the heating and mixing stage is connected via the second line L2 to the second pressurized air source.

An advantage of two separate pressurized air sources and/or two separate gas lines L2 and L4 each with a respective cutoff valve 2*a* or 2*b* is that the use of two cutoff valves, in contrast to a switching valve, is more cost effective and, due to the simpler control of the valve, a greater safety is achieved with respect to the switching process. In addition, it is ensured that no catalyst gas remains in the flushing line or heat source, which would delay the flushing process due to the resulting contamination. Furthermore, by means of the much higher temperature of the supplied flushing air (pressurized air heated by the heat source), the amount of catalyst needed can be strongly reduced, since catalyst condensed on the surface of the core becomes gaseous again much more rapidly and is thus driven rapidly into the core. By reducing the quantity of catalyst, the environmental pollution can be reduced, the costs of disposal of the catalyst gas are reduced, and the expense for cleaning the device is reduced.

Moreover, due to the separate feeding of the heated pressurized air to the gassing plate, it is possible to dispense with a safety temperature regulator, which has been needed in the previous installations in order to ensure that the temperature in the heating and mixing stage does not exceed a certain predetermined limit value, so that the safety of the installation is guaranteed.

Furthermore, no preheater is needed, since the gassing of the catalyst requires less heating power than the heating of the pressurized air for the flushing process. In this manner, energy can be saved, since the pressurized air to be heated for the flushing process is not cooled by line losses and since it does not need to be heated again subsequently possibly by means of a reheater.

As a result of these measures according to the invention, a compact reliable device which reduces environmental pollution by reducing the required amount of catalyst gas is achieved, and which overcomes the disadvantages of the prior devices and can work at the same speed (cycle time) as the known devices.

The invention claimed is:

1. Device for hardening foundry cores of a sand-containing molding material, wherein the device is adapted in order to subject the core, for its hardening, in a core molding tool, to a catalyst vapor/carrier gas mixture and subsequently to a pressurized air stream, each at a predetermined pressure and a predetermined temperature, wherein the device comprises:

a heating and mixing stage (12), which is upstream of the core molding tool and which is in fluidic connection with a container (7) containing an organic catalyst in liquid form by means a first line (L), wherein the liquid organic catalyst is fed to the heating and mixing stage (12) dosed via dosing means (8-11), wherein the heating and mixing stage (12) furthermore is in fluidic connection with a pressurized air source (1) via at least one first pressure regulator (6*a*) by means of a second separate line (L2), so that the pressurized air used as carrier gas is fed in a dosed form to the heating and mixing stage (12), wherein the liquid organic catalyst fed to the heating and mixing stage (12) and the pressurized air fed to the heating and mixing stage (12) are heated in the heating and mixing stage (12), so that the organic catalyst assumes its gaseous state, and together with the pressurized air, a catalyst vapor/carrier gas mixture is produced, wherein the heating and mixing stage (12) is moreover connected via a third line (L3), which is closed by a valve (5), to the core molding tool, so that the catalyst vapor/carrier gas mixture is passed through the sand-containing molding material in the core molding tool, wherein, for a time-controlled flushing after the passage of the catalyst vapor/carrier gas mixture through the sand-containing molding material, the core molding tool, by a fourth line (L4) which is closed with a valve (4), is in fluidic connection with the pressurized air source (1) via a heating source (3) which is adapted in order to heat the pressurized air streaming from the pressurized air source (1) through the heat source (3) to a predetermined temperature, characterized in that the device has no preheater that heats the pressurized air (1) before it is fed to the heating and mixing stage (12) or to the heat source (3), so that the organic catalyst and the pressurized air are heated together in the heating and mixing stage (12), and a first cutoff valve (2*a*) is arranged in the second line (L2), which is closed at the beginning of the flushing, and a second cutoff valve (2*b*) is arranged in the fourth line (L4), which is open at the beginning of the flushing.

2. Device according to claim 1, characterized in that the device has two pressurized air sources (1), of which the first is connected to the heating and mixing stage (12) and the second is connected to the heat source (3).

3. Device according to claim 1, characterized in that a temperature control for the heat source (3) is connected.

4. Device according to claim 1, characterized in that, before the feeding of the catalyst in liquid form into the heater and mixing device (12), the feed of the liquid catalyst container (7) is rerouted temporarily by means of one of the dosing means (8-11) via a switching valve to a return line to the liquid catalyst container (7), for the pressure equalization in the feed system.

5. Device according to claim 1, characterized in that the third line (L3) and the portion of the fourth line (L4) which adjoins the heat source (3) is heated.

6. A method for hardening foundry cores of sand-containing molding materials, wherein the core, for its hardening, is subjected in a core molding tool to a catalyst vapor/carrier gas mixture and subsequently to a pressurized air stream, each at a predetermined pressure and a predetermined temperature, comprising the steps of:

feeding in a dosed form to a heating and mixing stage, an organic catalyst in liquid form and converting it there into its gaseous state;

passing pressurized air within a predetermined time period and under a proportional pressure increase, through the heating and mixing stage charged with the catalyst gas after gas-tight coupling of a gassing plate, for a time-controlled gassing;

passing the pressurized air, as a catalyst vapor/carrier gas mixture, through the sand-containing molding material in the core molding tool; and then passing the pressurized air, for a time-controlled flushing, within a predetermined time period, by a separate feed line through a gassed sand-containing molding material in the core molding tool, characterized in that, the pressurized air which is passed through the heating and mixing stage for a time-controlled gassing, is heated only once when it is in the heating and mixing stage, together with the organic catalyst, and the pressurized air used for the time-controlled flushing is conducted and heated by means of a heating source in a separate line.

7. Method according to claim 6, characterized in that, before feeding the catalyst in liquid form to the heating and mixing stage (12), a pressure equalization is performed in the feed.

8. Method according to claim 6, characterized in that the catalyst vapor/carrier gas mixture is accompanied by heat on its way to the core molding tool.

* * * * *